United States Patent [19]

Frick

[11] 3,930,559

[45] Jan. 6, 1976

[54] SOUND INSULATING HOODS FOR NOISE EMITTING APPARATUS

[76] Inventor: Berndt Ebbe Frick, Tyreso, Sweden

[22] Filed: Feb. 26, 1975

[21] Appl. No.: 552,968

Related U.S. Application Data

[63] Continuation of Ser. No. 416,425, Nov. 16, 1973, abandoned.

[30] Foreign Application Priority Data

Nov. 17, 1972 Sweden ..... 15036/72

[52] U.S. Cl. ..... 181/33 K; 197/186 B

[51] Int. Cl.[2] ..... E04B 1/82

[58] Field of Search ..... 181/33 K; 197/186 B; 312/25, 29, 208, 284; 178/42

[56] References Cited

UNITED STATES PATENTS

| | | | |
|---|---|---|---|
| 1,246,203 | 11/1917 | Willman | 312/29 |
| 1,686,016 | 10/1928 | Lindburg | 197/186 B |
| 2,046,695 | 7/1936 | Mottram | 178/42 X |
| 2,111,644 | 3/1938 | Singer | 181/33 K UX |
| 2,241,797 | 5/1941 | Weidner | 181/33 K UX |
| 2,256,547 | 9/1941 | Burdick | 181/33 K UX |
| 2,270,249 | 1/1942 | Birkmeyer | 181/33 K UX |
| 2,701,618 | 2/1955 | Montgomery | 181/33 K UX |
| 2,893,533 | 7/1959 | Childs | 181/33 K UX |
| 3,747,735 | 7/1973 | Frick | 197/186 B |
| 3,785,452 | 1/1974 | Scott | 181/33 K |

FOREIGN PATENTS OR APPLICATIONS

| | | | |
|---|---|---|---|
| 204,964 | 10/1923 | United Kingdom | 197/186 B |
| 492,502 | 9/1938 | United Kingdom | 181/33 K |

*Primary Examiner*—Jonn F. Gonzales
*Attorney, Agent, or Firm*—Eric Y. Munson

[57] ABSTRACT

A sound insulating hood or cover for a noise emitting apparatus such as teleprinter having a bottom portion, two side walls, a front wall, a back wall and an upper portion. The inner dimension of the hood slightly exceeds the dimension of the apparatus. At least the front wall being constructed to co-act with rest of the hood via a hinged joint, enabling the front wall to pivot to a position exposing and to a position enclosing the apparatus. In exposed position the apparatus can be withdrawn from the hood to a position suitable for servicing, inspection and the like.

5 Claims, 4 Drawing Figures

SOUND INSULATING HOODS FOR NOISE EMITTING APPARATUS

This is a continuation, of application Ser. No. 416,425 filed Nov. 16, 1973, and now abandoned.

FIELD OF THE INVENTION

The present invention relates to sound insulating hoods, and especially to such a sound insulating hood designed to envelope noisy apparatus i.e. an apparatus causing or emitting noise.

Although the invention is applicable to any noise emitting apparatus for reducing the noise produced thereby, the following exemplification of the application of the invention will be described in connection with a teleprinter.

DESCRIPTION OF THE PRIOR ART

It is previously known to construct sound insulating hoods consisting of a bottom portion, from which extend two side walls, a front wall, a rear wall and an upper portion, the inside dimension of the hood barely exceeding the dimension of the sound generating apparatus. On the inside, the hood is covered with one or more sound insulating layers, thus effectively lowering the audible sound level from the noise emitting apparatus.

In the practical application of such sound insulating hoods, it has been found that it is difficult to arrange for service, inspection and the like, of the noise emitting apparatus by service personnel. It has also been difficult to design the hood so that the apparatus can easily be used by the operating staff, i.e. the apparatus must be easily accessable inspite of the hood.

OBJECT OF THE PRESENT INVENTION

Attempts to form the sound insulating hood in order to facilitate service, inspection and the like have been found to result in reduced sound insulation and in most cases only a very slight degree of sound insulation. Even if in an odd case it has been possible to impart a sound insulating effect to the hood, it has as a rule been necessary to lift up the whole hood to enable the service personnel to carry out the necessary inspections. Such a procedure requires space, not least on the upper side of the hood, which makes it impossible to place two hoods above each other and to maneuver the one while sitting down and the other while standing up.

The present invention contemplates a sound insulating hood in which the above-mentioned disadvantages have been eliminated, which at the same time imparts a high sound insulating level to the hood construction in a simple and efficient manner.

What may be regarded as the principal distinguishing features of the sound insulating hood according to the present invention resides in the fact that at least the front wall is constructed to coact with the rest of the hood via a hinged joint thus enabling the front wall to pivot to a position exposing the noise emitting apparatus and to a position enclosing the same. In the exposed position the apparatus can be withdrawn from the hood to a position suitable for servicing, inspection and the like.

BRIEF DESCRIPTION OF THE DRAWING

FIG. 2 shows the hood in FIG. 1 in a position where the noise emitting apparatus in the form of a teleprinter has been withdrawn from the hood to a position for service, inspection and the like, FIG. 3 is a side view of a stand designed for two sound insulating hoods placed above each other, while

DESCRIPTION OF THE PREFERRED EMBODIMENT

Figure 1:
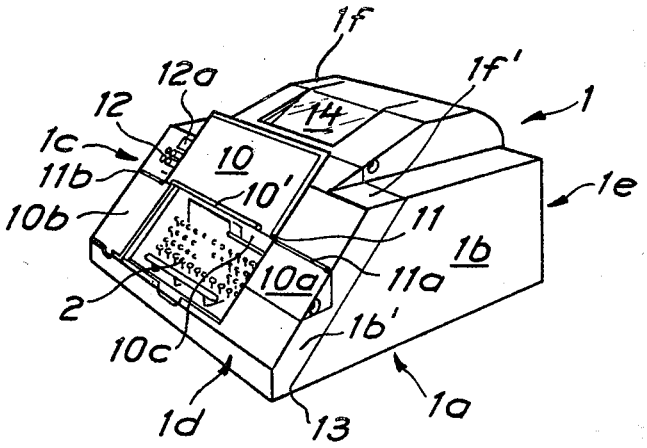
FIG. 1 is a side elevation of a sound insulated hood constructed according to the invention.

A side view of a sound insulating hood designed to enclose a noise emitting apparatus is shown in FIG. 1. In the following description the application of the invention is related to a teleprinter, the sound insulating hood 1 enclosing a teleprinter 2. The sound insulating hood 1 has a bottom portion 1*a* from which extend two side walls 1*b*, 1*c*, a front wall 1*d*, a rear wall 1*e* and an upper portion 1*f*. The inside dimensions of hood 1 are proportioned so as to only slightly exceed the dimensions of the apparatus 2. The sound insulating hood on its inside is further provided with one or more sound insulating layers designed to lower the sound level outside the hood in relation to the sound level inside the hood.

In FIG. 1 the hood 1 is shown mainly in an unopened position, thereby illustrating that the front wall 1*d* is formed with a number of hatches providing access to the apparatus 2. Door 10 is designed to be lifted up to obtain access to the key-board of the teleprinter 2. In FIG. 1 the hatch 10 is shown in raised position. Hatch 10 is raised via hinged joint 11, for access to an automatic sender. Hatch 10 is provided with a hinged joint 11 which connects it to the front wall 1*d* so that with the help of a rail 10 the inner surface of the door 10 can serve as a support for manuscripts and the like. There is also a door 10*b* which via a hinged joint 11*b* is also capable of being raised to allow the removal of a collecting bowl or the like for waste from punched tapes. A plurality of push buttons 12 are provided for operating the contact means on teleprinter 2. A window 12*a* is inserted into the hood in the vicinity of the push buttons to allow checking the introduction of tape into the tape punching device.

It will be understood that the whole of the front portion can be let down via a hinged joint 13 in the bottom portion 1*a*. It will also be noted that when the front portion 1*d* is let down, a part of the side wall 1*b'* and a part of the upper portion 1*f'* will follow the movement of the front portion 1*d*. In a similar manner a portion of the side wall 1*c* will also follow the movement of the front portion 1*d*.

It will also be noted that the front portion carries an inner flap 10*c*, which extends from the keys towards the inner surface of the front portion 1*d*. The flap 10*c* is situated behind the keys in the closed position of the hood. A hinged joint 11*c* firmly unites the flap 10*c* with the front portion 1*d*. With the help of spring means not shown in the figure, the flap 10*c* is pressed in towards the hood so that when the front portion 1*d* is closed against the remainder of hood 1, the free end of flap 10*c* will pass over the keys and creep down behind the keys with the help of guiding means not shown in the figure.

Figure 2:
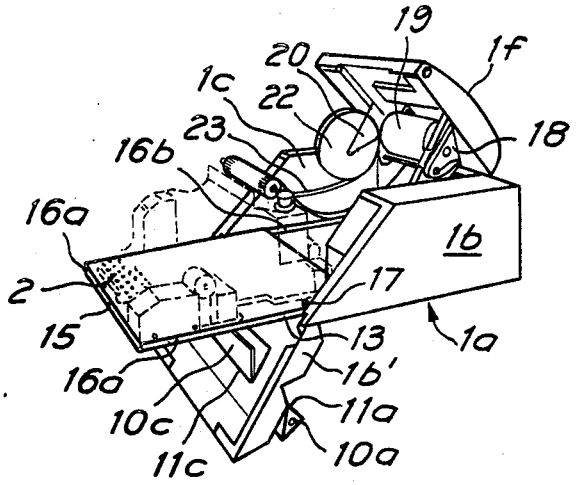

The upper portion 1*f* is also formed as a hatch, which by means of a hinged joint at the upper portion of the rear wall may be opened up to the position shown in FIG. 2. The upper portion 1*f* is provided with a window 14 through which messages from the teleprinter 2 can be read. The configuration of the upper portion in the opened position is most easily seen from the position shown in FIG. 2.

The invention includes a bottom plate 15 being arranged inside the hood 1 and at a slightly spaced distance from the bottom portion 1*a*, the distance obviously being calculated from the surface of the bottom portion facing the inside of the hood. The bottom plate 15 is designed to carry the noise emitting apparatus 2, in this case a teleprinter, the outer casing or cover of which has been removed. For the sake of clarification the teleprinter 2 has only been outlined in phantom in FIG. 2.

The invention is based on the concept that least the front wall 1*d* is designed to cooperate with the other parts of hood 1 by means of a hinged joint 13, thereby to allow the front wall 1*d* to be swung to a position exposing the noise emitting apparatus 2 as illustrated in FIG. 2, and alternately to a position enclosing the noise emitting apparatus which in general is shown in FIG. 1.

The invention also includes the feature that the noise emitting apparatus 2 can be withdrawn from the hood 1 to the exposed position, as in FIG. 2, for service, inspection and the like. For practical reasons, the hinged joint 13 should be located in the bottom portion 1*a*. The noise emitting apparatus 2 thus cooperates with the hood so that it may be pulled out a distance corresponding to the length of the apparatus.

The bottom plate 15 is displaceable relative to hood 1 by means of guide means. It is advantageous to arrange the guide means and the bottom plate parallel to the bottom portion 1*a*. A portion of each guide is placed on plate 15 and has been given the designation 16*a*. This portion cooperates with a portion not shown in FIG. 2 which is located in the hood and attached to the side wall 1*b*. The plate 15 carries two guide members and the portion 16*a* cooperates with a portion 16*b* attached to the sidewall 1*c*. Guides 16*a* and 16*b* are provided with holes at their upper portions, said holes being capable of cooperating with stop means 17, thereby preventing too great an extension of the bottom plate from hood 1. By placing the holes at different distances the displacement of plate 15 can be locked at previously determined distances from the hood.

The upper portion 1*f* cooperates with hood 1 by means of a hinged joint not shown in FIG. 2, but which is located on the upper portion of the rear wall. Via means 18, the upper portion 1*f* carries a roll 19 of paper which is fed through the teleprinter 2 for printing messages thereon. Attached to the upper portion 1*f* is a holder 20 for a roll 22 of tape 23, said tape being used for the reception of information by code punching. The tape 23 is fed to a punching device known per se connected to the teleprinter 2 in a manner known per se. It should be noted that both the holders 18, which are two in number, for retaining the roll 19, and the holder 20 are fixedly attached to the hinged upper portion 1*f*. The advantage hereby obtained results from the fact that both the roll 19 and the roll 20 are elevated from the interior of the hood when portion 1*f* is swung open, thereby simplifying and improving their handling when the rollers are to be exchanged or adjusted. Furthermore, the rolls do not create any obstruction during inspection or when the apparatus 2 assumes the position shown in FIG. 2.

Figure 3:
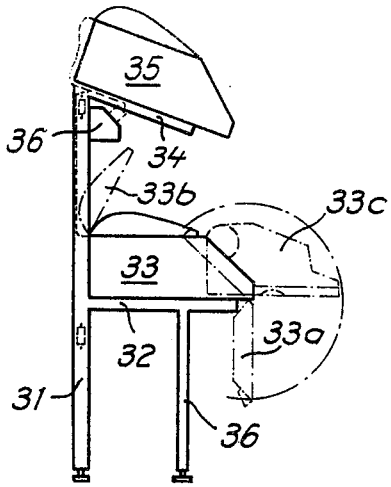

The invention also includes a stand to facilitate the mounting of hoods having the nature described above. The stand is formed by a pair of vertical posts 31, of which only one is shown in FIG. 3, since the stand is shown in a side view. At right angles from posts 31 there are two carrying rails 32 for a first hood 33, and at an acute angle to the posts 31 there are two carrying rails 34 for a second hood 33. Hood 33 is provided with a forward portion 33*a* and an upper portion 33*b* which can assume the position shown by dotted lines in FIG. 3, while the teleprinter 33*c* can be drawn out to the position shown by dotted lines in FIG. 3.

The carrying rails 32 attached at right angles to posts 31 are each supported by a leg 36 placed at a distance from posts 31. The carrying rails 34 attached at an acute angle to posts 31 are placed above the carrying rails 32 attached at right angles to the posts. A connecting unit 36, for the noise emitting apparatus inside hood 35 and/or 33 is placed adjacent a plane through the posts 31 and adjacent a plane through the carrying rails 34 attached at an acute angle to the posts. This construction allows a person sitting on a chair to operate the apparatus within the hood 33, while the apparatus enclosed in hood 35 can be operated by a person standing up.

Figure 4:
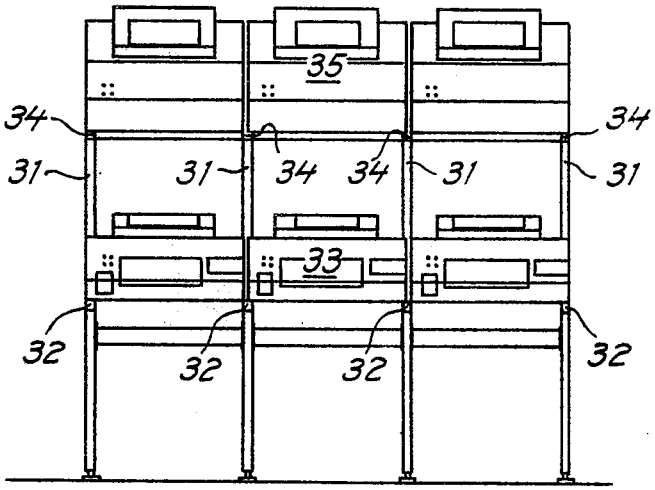
FIG. 4 is a front view of a stand for six hoods.

In FIG. 4 is shown a front view of a stand construction on which six sound insulating hoods can be supported. Four posts 31, placed side by side, are required for this purpose, a carrying rail 32 and a carrying rail 34 extending from each post. It will be apparent from FIG. 4 that the hoods 33 or hoods 35 can be swung open in the way shown in FIG. 3, and that the noise emitting apparatus can be withdrawn from the hoods to a position suitable for service, inspection and the like, without obstruction from the remaining hoods.

The invention is not limited to the embodiment described as an example above, but can be the subject of modifications within the framework for the following patent claims.

It may be mentioned that while exemplified the embodiment includes a bottom portion for the hood and a separate plate 15 for the apparatus 2, it is also possible to construct the plate 15 and the bottom portion as a single unit, this making the bottom portion withdrawable from the hood, the remaining portions being held together by a support or the like. It is also possible to exchange plate 15 for transverse struts, against which the supporting means for apparatus 2 are allowed to rest.

I claim:

1. A sound-insulating hood for snugly housing a key-operated noise-emitting apparatus such as a teleprinter and the like, said hood comprising:

a. a fixed bottom portion;

b. a pair of oppositely-disposed side walls and a back wall extending from said bottom portion;

c. a front wall hinged to said bottom portion and being movable between a closed position against the front edges of said side walls and a lowered position exposing said teleprinter and the like;

d. a top cover hinged to said back wall and being movable between a closed position overlying said side walls and a raised position to permit access to the interior of said hood from above;

e. a plate member supporting said apparatus slidably engaging said bottom portion to permit withdrawal thereof from the hood to make it available for service when said front wall in its lowered position;

f. said top cover having means for carrying a roll of fresh paper for receiving teletype messages and a roll of fresh paper for sending teletype messages, said rolls being raised to an elevated position together with said top cover to make them easily available for service and inspection;

g. said front wall and said top cover extending towards each other in such a manner that the front wall in its lowered position and the top cover in its raised position exposes said teleprinter and the like.

2. A hood according to claim 1, having portions of the side walls, a portion of the bottom and a portion of the top cover forming a part of the front wall.

3. A hood according to claim 1, said front wall having a hatch pivotally mounted thereon and a flap pivotally supported on the inner surface of said front wall and positioned such that said flap is located behind the keys of said apparatus when the front wall is in a closed position.

4. The combination of a stand for supporting a plurality of superposed hoods as defined in claim 1, said stand comprising:

a. first support means for supporting a first hood for the first lowermost teleprinter and the like at a proper working height above a floor for an operator in a sitting position;

b. second support means for supporting a second hood for the second teleprinter above said lowermost first hood at a height proper for an operator in a standing position;

c. said first and second hoods comprising guide means for slidably engaging said plate member to permit withdrawal of the teleprinter from the hoods;

d. said guide means in the second hood extending downwardly at an angle proper for the standing operator to facilitate the opening and closing of the hood and the withdrawal therefrom of the teleprinter.

5. The combination according to claim 4 having the first supporting means extending perpendicular to posts forming the stand and the second support means extending with an acute angle from said posts.

* * * * *